US006979785B2

(12) United States Patent
Yamasaki

(10) Patent No.: US 6,979,785 B2
(45) Date of Patent: Dec. 27, 2005

(54) MULTIDIRECTIONAL OPERATION SWITCH

(75) Inventor: Masato Yamasaki, Tsuyama (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 79 days.

(21) Appl. No.: 11/023,585

(22) Filed: Dec. 29, 2004

(65) Prior Publication Data

US 2005/0224321 A1 Oct. 13, 2005

(30) Foreign Application Priority Data

Apr. 9, 2004 (JP) ..... 2004-115285

(51) Int. Cl.[7] ..... H01H 25/06
(52) U.S. Cl. ..... 200/6 A
(58) Field of Search ..... 200/4, 5 R, 6 A, 200/17 R, 18, 406, 516; 345/157, 161; 273/148 R; 463/36–38; 74/471 R, 473.3, 471 XY, 473.33, 74/473.34, 473.35

(56) References Cited

U.S. PATENT DOCUMENTS

| | | | | |
|---|---|---|---|---|
| 5,889,242 | A * | 3/1999 | Ishihara et al. | 200/6 A |
| 6,344,618 | B1 * | 2/2002 | Sato | 200/6 A |
| 6,344,619 | B1 * | 2/2002 | Yamasaki et al. | 200/6 A |
| 6,570,107 | B1 * | 5/2003 | Nishimoto et al. | 200/6 R |
| 6,586,690 | B2 * | 7/2003 | Shimomura et al. | 200/6 A |
| 6,713,692 | B2 * | 3/2004 | Yamasaki | 200/6 A |
| 6,791,037 | B1 * | 9/2004 | Ling | 200/4 |
| 6,794,589 | B2 * | 9/2004 | Kubat et al. | 200/6 A |

FOREIGN PATENT DOCUMENTS

| | | |
|---|---|---|
| JP | 11-31440 | 2/1999 |

* cited by examiner

*Primary Examiner*—Michael A. Friedhofer
(74) *Attorney, Agent, or Firm*—Steptoe & Johnson LLP

(57) ABSTRACT

A multidirectional operation switch includes an insulation case having a recess having a bottom, an outer fixed contact provided on the bottom, plural inner fixed contacts provided on the bottom, a conductive cover for covering the recess of the case, a movable contact made of resilient conductive plate in the recess of the case and having a dome shape including a concave surface, a convex surface opposite to the concave surface, and a peripheral edge, plural first terminals provided on the case and electrically connected to the outer fixed contact and the plurality of inner fixed contacts, respectively, and a second terminal for allowing the cover to be electrically connect the case to an outside of the switch. Each of the inner fixed contacts departs from a predetermined point on the bottom by a predetermined distance shorter than a distance between the predetermined point and the outer fixed contact. The cover has a hole formed therein over the predetermined point. The peripheral edge of the movable contact is mounted on the outer fixed contact. The concave surface faces the inner fixed contacts, and has a deepest point located over the predetermined point. The operation body includes an operation shaft inserted into the hole of the cover and electrically insulated from the cover, and a conductive flange bonded to the operation shaft. The flange is located between the cover and the convex surface of the movable contact and over the fixed contacts. This switch is small and thin.

9 Claims, 12 Drawing Sheets

MULTIDIRECTIONAL OPERATION SWITCH

FIELD OF THE INVENTION

The present invention relates to a multidirectional operation switch including an operation shaft activated by tilting and pushing. The switch is often used as an input section of mobile communication equipment, such as a portable telephone, a pager, and various small multifunctional electronic equipment, such as a remote controller, audio equipment, game equipment, a car navigation system, a digital camera.

BACKGROUND OF THE INVENTION

A conventional multidirectional operation switch disclosed in Japanese Patent Laid-Open Publication No. 11-31440 will be described with reference to FIGS. 8 to 12. FIG. 8 is an exploded perspective view of the conventional multidirectional operation switch. FIG. 9 is a plan view of a case of the conventional multidirectional operation switch. FIG. 10 is a sectional view taken along line 10—10 of the multidirectional operation switch shown in FIG. 9. Case 1 made of insulation resin has a substantially square shape seen from its upper surface, and has a recess opening upward. Central fixed contact 2A is provided at the center of a bottom of the recess of case 1. Two outer fixed contacts 2B are provided at the periphery of the recess symmetrically with respect to each other about central fixed contact 2A. Inner fixed contacts 2C are arranged at the recess in eight directions at equal angular intervals from central fixed contact 2A between central fixed contact 2A and outer fixed contacts 2B. Four of inner fixed contacts 2C are located along directions from central fixed contact 2A to corners of case 1, and other four inner fixed contacts 2C are located between the four inner fixed contacts. Five terminals, i.e., terminal 8B and terminals 8C led out independently from one of outer fixed contacts 2B and four of inner fixed contacts 2C are aligned on outer side surface 1B of case 1. Similarly, five terminals, i.e., terminal 8B and terminals 8C led out independently from other of outer fixed contacts 2B and other four inner fixed contacts 2C are aligned on outer side surface 1C opposite to outer side surface 1B. As shown in FIG. 9, terminal 8A led out from central fixed contact 2A passes from the center of the recess of case 1 through between two of inner fixed contacts 2C and is provided on outer side surface 1A, which is different from the outer side surfaces 1B and 1C.

Movable contact 3 having a circular dome-shape and made of resilient metallic thin plate is accommodated in the recess of case 1, and has a peripheral lower edge mounted on outer fixed contact 2B. Hole 3A is formed at a central top portion of movable contact 3 and is larger than the outer diameter of central fixed contact 2A. Hole 3A faces central fixed contact 2A.

Operation body 4 made of insulation material includes operation shaft 4A and flange 4B which are unitarily formed with each other. Operation shaft 4A protrudes upward and has a substantially quadrangular cross section in a direction perpendicular to a direction in which the dome shape of movable contact 3 protrudes. Flange 4B is located below operation shaft 4A. Rivet portion 5 made of conductive material is attached to the lower portion of flange 4B.

A lower flat portion 5A of rivet portion 5 has a circular shape seen from upside. The circular shape of the lower flat portion 5A has a radius larger than a distance from central fixed contact 2A to inner fixed contact 2C. That is, central fixed contact 2A and inner fixed contact 2C are located below the lower flat portion 5A.

The lower surface of lower flat portion 5A of rivet portion 5 contacts the upper surface of the periphery of hole 3A of movable contact 3. Flange 4B of operation body 4 to which rivet portion 5 is attached is accommodated in the recess of case 1. An edge of lower flat portion 5A of rivet portion 5 is located substantially above inner fixed contacts 2C.

Cover 6 made of metal plate has bearing portion 6A having a substantially quadrangular at its central portion and holds operation body 4 so that operation shaft 4A of operation body 4 protrudes through bearing portion 6A. Cover 6 is attached to case 1 so as to cover the recess of case 1, so that each side of bearing portion 6A is in parallel to each side of the periphery of case 1.

An upper surface of flange 4B of operation body 4 contacts the lower surface of cover 6. That is, flange 4B of operation body 4 to which rivet portion 5 is attached is located between the lower surface of cover 6 and the upper surface of movable contact 3. In an ordinary state shown in FIG. 10, an operation force is not applied to operation shaft 4A, and operation body 4 keeps a neutral position perpendicular to the bottom of the recess of case 1. Operation knob 7 is placed at the upper end portion of operation shaft 4A of operation body 4.

An operation of the multidirectional operation switch configured as mentioned above will be described. FIGS. 10 to 12 are sectional views of the conventional multidirectional operation switch.

As shown in FIG. 10, when operation body 4 is in a neutral position and an operation force is not applied to operation shaft 4A, the switch is in a ordinal state in which any of outer fixed contacts 2B, inner fixed contacts 2C, and central fixed contact 2A do not contact each other. Inner fixed contacts 2C do not contact.

As shown in FIG. 11, the left side of the upper surface of operation knob 7 placed at the upper end portion of operation shaft 4A of operation body 4 is depressed in direction D11, and operation body 4 accordingly tilts with respect to the right side of the upper end portion of flange 4B, a fulcrum. Then, the left side of edge 5A1 of lower flat portion 5A of rivet portion 5 fixed to the lower surface of the flange 4B presses the left side of the upper surface of movable contact 3 above inner fixed contact 2C located at the left side. Simultaneously to this, the portion of movable contact 3 partly bends and generates a click feeling. Then, inner fixed contact 2C arranged at the left side and outer fixed contact 2B are electrically connected via movable contact 3, and thereby, predetermined terminals 8C and 8B corresponding to fixed contacts 2C and 2B are electrically connected. At this moment, since the central top portion of movable contact 3 has the hole larger than central fixed contact 2A, central fixed contact 2A does not contact movable contact 3. Since rivet portion 5 attached to the lower surface of flange 4B tilts together with flange 4B of operation body 4, rivet portion 5 does not contact central fixed contact 2A.

Then, when the force applied to operation knob 7 is removed, movable contact 3 restores its original shape by a restoring force of the contact and departs from inner fixed contact 2C arranged at left side mentioned above. Then, operation body 4 is pushed back to the original, neutral position, so that the fixed contacts do not contact, as shown in FIG. 10.

Similarly, when a position of operation knob 7 on operation body 4 corresponding to inner fixed contacts 2C is pushed, inner fixed contact 2C corresponding to the position and outer fixed contact 2B are electrically connected, thereby allowing terminals 8C and 8B corresponding to the fixed contacts to be electrically connected. When the pressing force is removed, the switch returns to the ordinal state shown in FIG. 10.

As shown in FIG. 12, when operation body 4 is pressed with a pressing force applied from the central upper surface of operation knob 7 in direction D2, i.e., from an upper side to a lower side, lower flat portion 5A of rivet portion 5 fixed to flange 4B of operation body 4 presses the central portion of movable contact 3. Thereby, movable contact 3 entirely inverts, generating a click feeling. Simultaneously to this, the center of lower portion of the lower flat portion 5A of rivet portion 5 contacts central fixed contact 2A exposing through hole 3A of movable contact 3. As a result, central fixed contact 2A and outer fixed contacts 2B are electrically connected via movable contact 3 contacting rivet portion 5, thus allowing terminals 8A and 8B corresponding thereto to be electrically connected.

Then, when the pressing force is removed, operation body 4 is pushed up by a restoring force of movable contact 3, so that the switch returns to the state shown in FIG. 10, in which the switch are turned off.

In the conventional multidirectional operation switch, two outer fixed contacts 2B, eight inner fixed contacts 2C for tilting operation and central fixed contact 2A for pushing operation are arranged on the bottom of the recess of case 1. In order to lead out terminal 8A from central fixed contact 2A, it is necessary to lead out the terminal 8A through between two of inner fixed contacts 2C arranged in the eight directions at the equal intervals. The switch is recently demanded to have a small size to provide small and thin apparatuses, and the intervals between the contacts become narrow accordingly, thus limiting the small size. Terminal 8A may be led out from central fixed contact 2A to a position different from the positions of the other terminals in the thickness direction of case 1. However, in this case, since portions where terminals are led out cannot be formed in one plane, processes are likely to be complicated. Further, case 1 has a large thickness accordingly, and thus, it is difficult to make the switch thin.

SUMMARY OF THE INVENTION

A multidirectional operation switch includes an insulation case having a recess having a bottom, an outer fixed contact provided on the bottom, plural inner fixed contacts provided on the bottom, a conductive cover for covering the recess of the case, a movable contact made of resilient conductive plate in the recess of the case and having a dome shape including a concave surface, a convex surface opposite to the concave surface, and a peripheral edge, plural first terminals provided on the case and electrically connected to the outer fixed contact and the plurality of inner fixed contacts, respectively, and a second terminal for allowing the cover to be electrically connect the case to an outside of the switch. Each of the inner fixed contacts departs from a predetermined point on the bottom by a predetermined distance shorter than a distance between the predetermined point and the outer fixed contact. The cover has a hole formed therein over the predetermined point. The peripheral edge of the movable contact is mounted on the outer fixed contact. The concave surface faces the inner fixed contacts, and has a deepest point located over the predetermined point. The operation body includes an operation shaft inserted into the hole of the cover and electrically insulated from the cover, and a conductive flange bonded to the operation shaft. The flange is located between the cover and the convex surface of the movable contact and over the fixed contacts.

This switch is small and thin.

DETAILED DESCRIPTION OF THE PREFERRED EMBODIMENT

Figure 1:
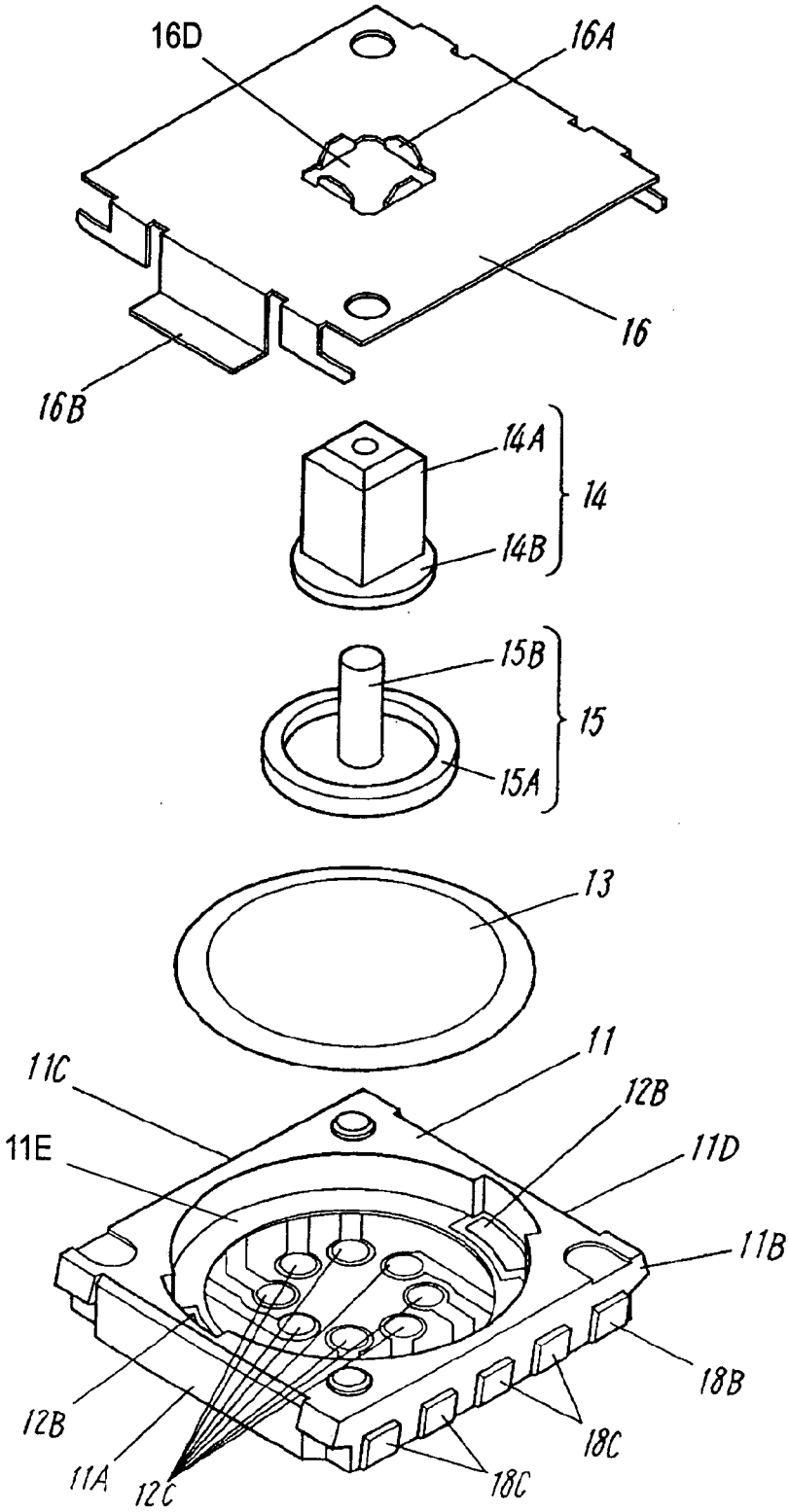
FIG. 1 is an exploded perspective view of a multidirectional operation switch according to an exemplary embodiment of the present invention.
Figure 2:
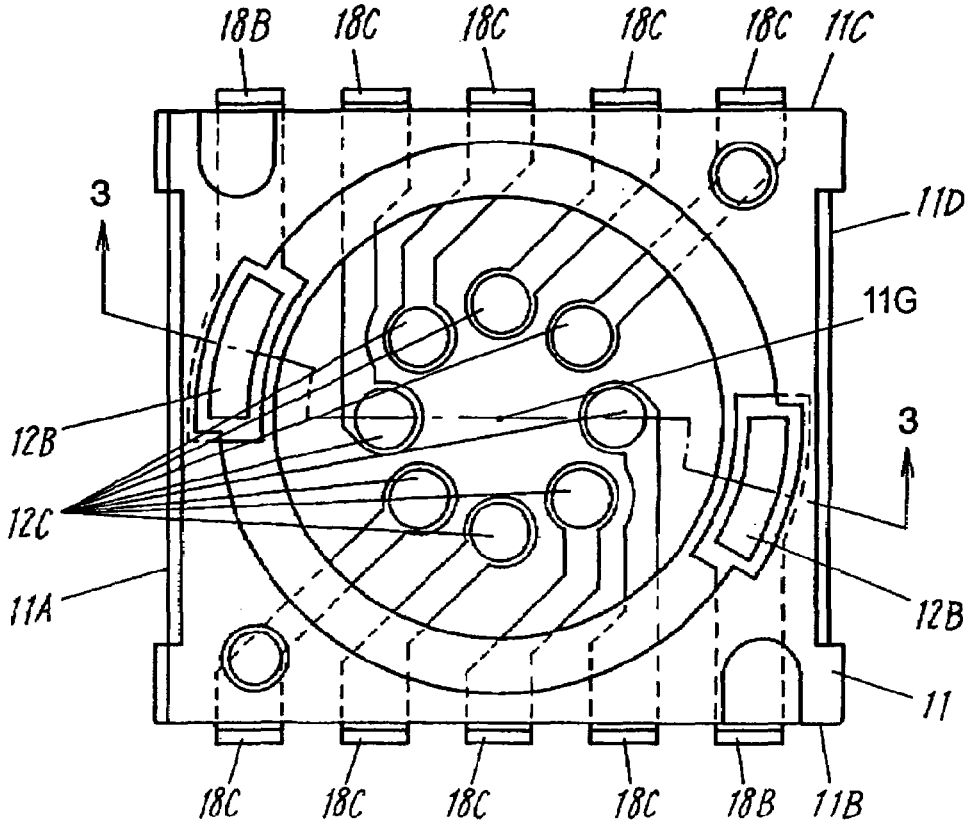
FIG. 2 is a plan view showing a case of the multidirectional operation switch according to the embodiment.
Figure 3:
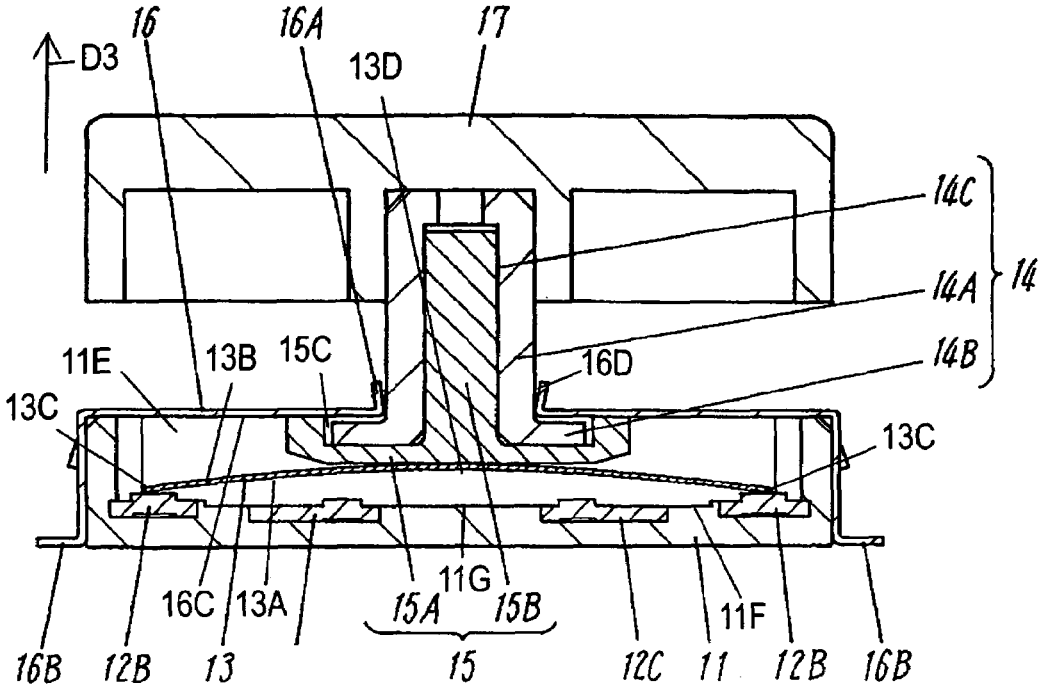
FIG. 3 is a sectional view of the multidirectional operation switch according to the embodiment taken along line 3—3 of FIG. 2.

FIG. 1 is an exploded perspective view of a multidirectional operation switch according to an exemplary embodiment of the present invention. FIG. 2 is a plan view of a case of the multidirectional operation switch according to the embodiment. FIG. 3 is a sectional view of the multidirectional operation switch taken along line 3—3 of FIG. 2 according to the embodiment. Case 11 made of insulation resin has recess 11E formed therein. Recess 11E opens upward and has bottom 11F. Two outer fixed contacts 12B are provided on the periphery of recess 11E of case 11 symmetrically with respect to each other about central point 11G of the bottom 11F. Each of eight inner fixed contacts 12C is arranged on bottom 1F depart from a predetermined central point 11G by a distance shorter than a distance between outer fixed contact 12B and central point 11G. Eight inner fixed contacts 12C are arranged on bottom 11F around central point 11G as a center at equal angular intervals. Four of inner fixed contacts 12C are located in respective directions extending from central point 11G to corners of case 11, and other four of inner fixed contacts 12C are located between the four inner fixed contacts 12C. A portion between central point 11G of bottom 11F and each of inner fixed contracts 12C including central point 11G is lower than inner fixed contacts 12C.

Terminal 18B and terminals 18C led out independently from one of two outer fixed contacts 12B and four of eight inner fixed contacts 12C are aligned on outer side surface 11B of case 11. Similarly, terminal 18B and terminals 18C led out independently from other of outer fixed contacts 12B and other four inner fixed contacts 12C are aligned on outer side surface 11C opposite to outer side surface 11B.

Movable contact 13 having a circular dome shape and made of resilient metallic thin plate, resilient conductive plate, protrudes in direction D3, as shown in FIG. 3. Movable contact 13 is accommodated in recess 11E of case 11 and has peripheral lower edge 13C mounted on outer fixed contacts 12B of case 11 to contact outer fixed contacts 12B. Inner fixed contacts 12C face concave surface 13A of movable contact 13 by a predetermined space. Deepest point 13D of concave surface 13A is located above central point 11G and faces central point 11G.

Operation body 14 made of insulation material includes operation shaft 14A protruding upward and having a substantially quadrangular horizontal cross section, and flange 14B unitarily formed with the operation shaft 14A at the lower side of the operation shaft 14A. Mounting portion 15B of insulation material having a rod shape protrudes toward from a central upper portion of rivet portion 15, and is fitted into hole 14C extending upward from the center of the lower surface of flange 14B along a central axis of operation shaft 14A, so that rivet portion 15 is fixed to operation body 14. Flange 14B is accommodated in recess 15C provided in disk-like portion 15A disposed at the lower side of rivet portion 15, so that the lower surface of flange 14B is covered with disk-like portion 15A.

Disk-like portion 15A of rivet portion 15 has a circular shape equal to or larger than an area below which eight inner fixed contacts 12C are located. An edge of disk-like portion 15A of rivet portion 15 is located substantially above inner fixed contacts 12C. The lower surface of disk-like portion 15A contacts a central top portion of movable contact 13. Flange 14B is accommodated in recess 11E of case 11 together with disk-like portion 15A of rivet portion 15.

Cover 16 made of conductive metal covers an opening of recess 11E of case 11. Cover 16 has bearing portion 16A having quadrangular hole 16D through which operation shaft 14A protruding from the central upper part of the operation body 14 is inserted. Hole 16D holds a bottom of operation shaft 14A. Hole 16D is located above central point 11G. Cover terminals 16B is provided by extending ends of cover 16 from outer side surfaces 11A and 11D in a direction in which outer side surfaces 11B and 11C extend. Outer side surfaces 11A and 11D face each other and are perpendicular to outer side surfaces 11B and 11C of case 11 having terminals 18B and 18C thereon. Cover terminal 16B is electrically connected to cover 16 to function as a cover connection portion electrically connecting cover 16 to outside of the switch.

Bearing portion 16A of cover 16 has a substantially quadrangular shape having sides thereof parallel to outer side surfaces 11A to 11D, respectively. Bearing portion 16A is engaged with operation shaft 14A, allowing operation body 14 to tilt and move upward and downward, but disabling body 14 to rotate.

Peripheral upper surface of disk-like portion 15A of rivet portion 15 contacts lower surface 16C of cover 16. Rivet portion 15 and operation body 14 having rivet portion 15 fixed thereto are held between lower surface 16C of cover 16 and convex surface 13B of movable contact 13, and are in a neutral position in an ordinary state shown in FIG. 3. In the ordinary state, no operation force is applied to the operation body 14, and thus, operation shaft 14 is not activated. Operation knob 17 is bonded to the upper end of operation shaft 14A of operation body 14 by, for example, press-fitting.

Figure 4:
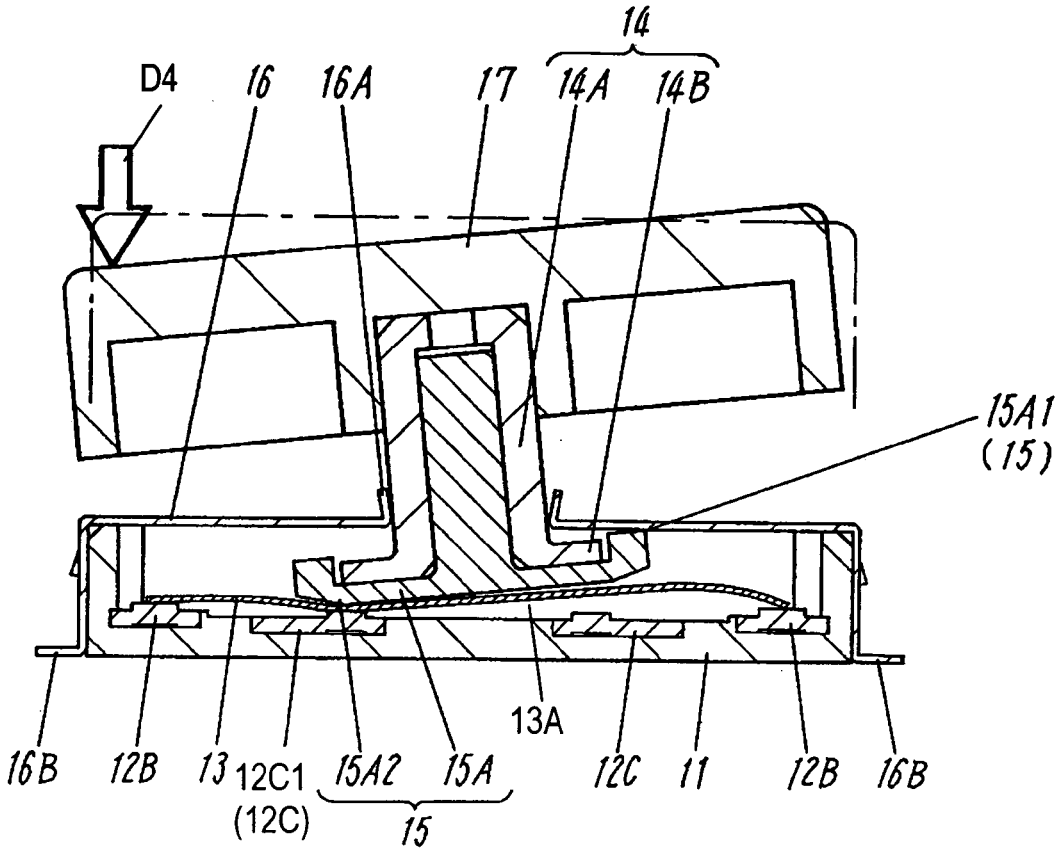
FIG. 4 is sectional view the multidirectional operation switch which is activated according to the embodiment.
Figure 5:
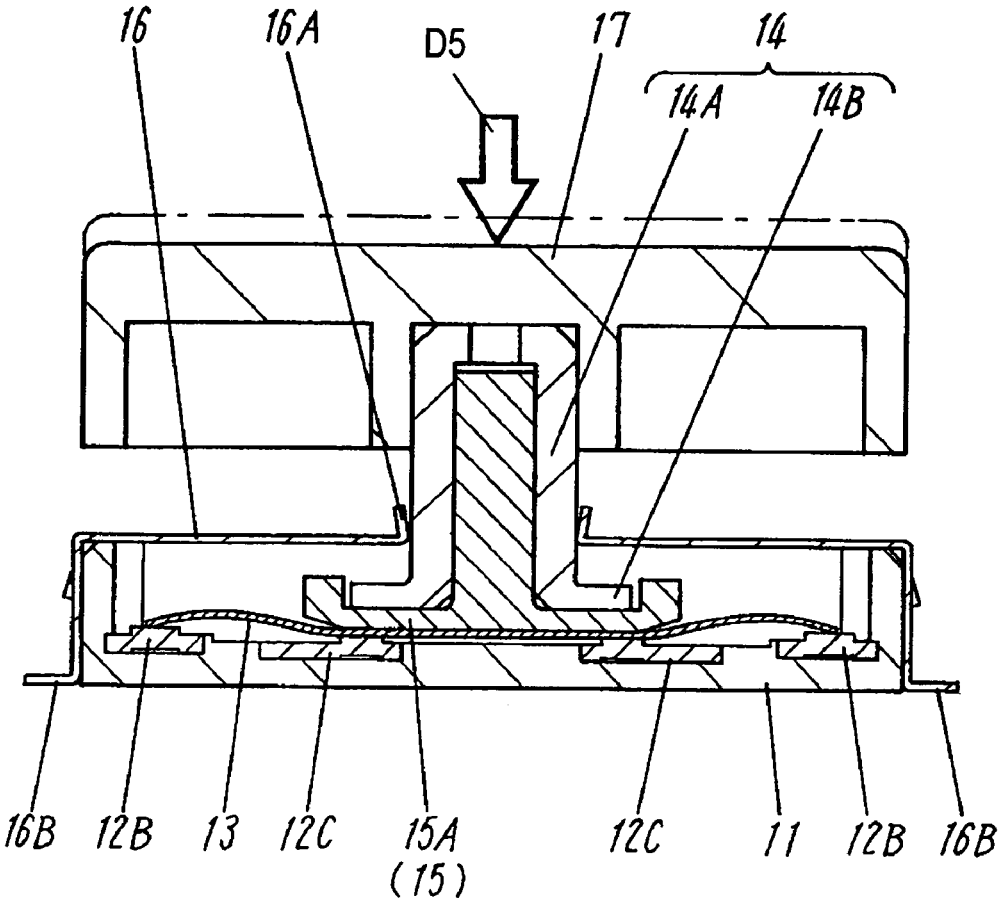
FIG. 5 is sectional view of the multidirectional operation switch which is activated according to the embodiment.

An operation of the multidirectional operation switch configured as mentioned above will be described. FIGS. 4 and 5 are sectional views of the multidirectional operation switch according to the embodiment which is activated.

As shown in FIG. 3, when operation body 14 is in the neutral position and operation force is not applied to operation shaft 14A, cover 16 and outer fixed contact 12B in the recess 11E of case 11 are electrically connected via disk-like portion 15A of rivet portion 15 and movable contact 13. Outer fixed contacts 12B and eight inner fixed contacts 12C of case 11 are not electrically connected. Inner fixed contacts 12C are not electrically connected.

As shown in FIG. 4, when the left side of upper surface of operation knob 17 is pressed in direction D4 by, e.g. a finger, operation body 14 tilts with respect to the right upper peripheral portion 15A1 of disk-like portion 15A as a fulcrum. According to the tilting of the operation body 14, side end portion 15A2 of disk-like portion 15A of rivet portion 15 presses the upper surface of the movable contact 13 located above inner fixed contact 12C1 out of eight inner fixed contacts 12C. Movable contact 13 accordingly bends partly, generating a click feeling. Then, concave surface 13A of movable contact 13 contacts inner fixed contact 12C1, so that the outer fixed contact 12B and inner fixed contact 12C1 are electrically connected via movable contact 13, thus electrically connecting terminals 18B led out from fixed contact 12B with terminal 18C led out from fixed contact 12C1.

When the pressing force applied to operation knob 17 is removed, movable contact 13 restores its original shape, so that movable contact 13 departs from inner fixed contact 12C1. Simultaneously to this, operation body 14 is pushed back to the neutral position by the restoring force of the contact 13. Consequently, as shown in FIG. 3, outer fixed contacts 12B and eight inner fixed contacts 12C of case 11 are not electrically connected, thus having inner fixed contacts 12C not connected electrically.

When operation body 14 tilts, cover 16 and outer fixed contacts 12B are always connected electrically via disk-like portion 15A of rivet portion 15 and movable contact 13. Therefore, cover terminal 16B and terminal 18B from outer fixed contact 12B are electrically connected.

When a position of operation knob 17 corresponding to inner fixed contact 12C placed on operation body 14 is pressed, similarly, operation body 14 tilts in a direction pressed. According to the tilting of operation body 14, cover terminal 16B, terminal 18B, and at least one of inner fixed contacts 12C corresponding to the direction of the tilting are electrically connected with outer fixed contact 12B via movable contact 13, thus allowing the corresponding terminals 18C and 18B to be electrically connected. When the pressing force is removed, the switch returns to the ordinary state shown in FIG. 3. A position between two inner fixed contacts out of eight inner fixed contacts 12C adjacent to each other may be pressed, connecting the two inner fixed contacts with outer fixed contacts 12B.

As shown in FIG. 5, when the central part of the upper surface of operation knob 17 is pressed in direction D5 with, e.g. a finger, peripheral upper surface of disk-like portion 15A of rivet portion 15 departs from the lower surface of cover 16, disconnecting cover 16 from outer fixed contacts 12B on case 11 electrically. Then, entire operation body 14 moves downward, and rivet portion 15 presses the central top portion of movable contact 13 so as to bend movable contact 13 entirely. Thereby, dome-shaped movable contact 13 entirely inverts, generating a click feeling. When concave surface 13A of movable contact 13 contacts at least one inner fixed contact of eight inner fixed contacts 12C, outer fixed contact 12B is electrically connected to the one inner fixed contact via movable contact 13. Then, terminal 18B led out from fixed contact 12B is electrically connected with terminal 18C led out from the one inner fixed contact.

Under the above situation, cover 16 is not electrically connected with outer fixed contact 12B on case 11, and outer fixed contact 12B is electrically connected with the at least one of inner fixed contact of eight inner fixed contacts 12C. This situation may be detected through cover terminal 16B and terminals 18B and 18C, hence allowing the pushing of switch to be recognized.

When the pressing force to operation knob 17 is removed, movable contact 13 restores its original dome shape, and operation body 14 is pushed up by the restoring force of the contact 13, so that the peripheral upper surface of the disk-like portion 15A of river portion 15 contacts the lower surface of cover 16 so as to be stopped. Then, the switch returns to the ordinary state shown in FIG. 3 where cover 16 is electrically connected with outer fixed contacts 12B on case 11, outer fixed contacts 12B and eight inner fixed contacts 12C are not electrically connected, and eight inner fixed contacts 12C are not electrically connected.

Thus, in the multidirectional operation switch according to the embodiment, outer fixed contacts 12B is electrically connected with cover 16 in the ordinary state, i.e., an inactivated state. Then, when operation body 14 tilts, outer fixed contact 12B, inner fixed contact 12C corresponding to the tilting direction and cover 16 are electrically connected. When operation body 14 is pressed, outer fixed contact 12B is not connected electrically with cover 16, and outer fixed contact 12B is electrically connected with at least one of inner fixed contacts. An electrical connection of terminals 18B, 18C, and 16B may be detected, allowing an operation state to be recognized without a central fixed contact of a conventional multidirectional operation switch shown in FIGS. 8 to 12. The multidirectional operation switch according to the embodiment includes fixed contacts fewer than those of conventional switch, being small and thin.

Figure 6:
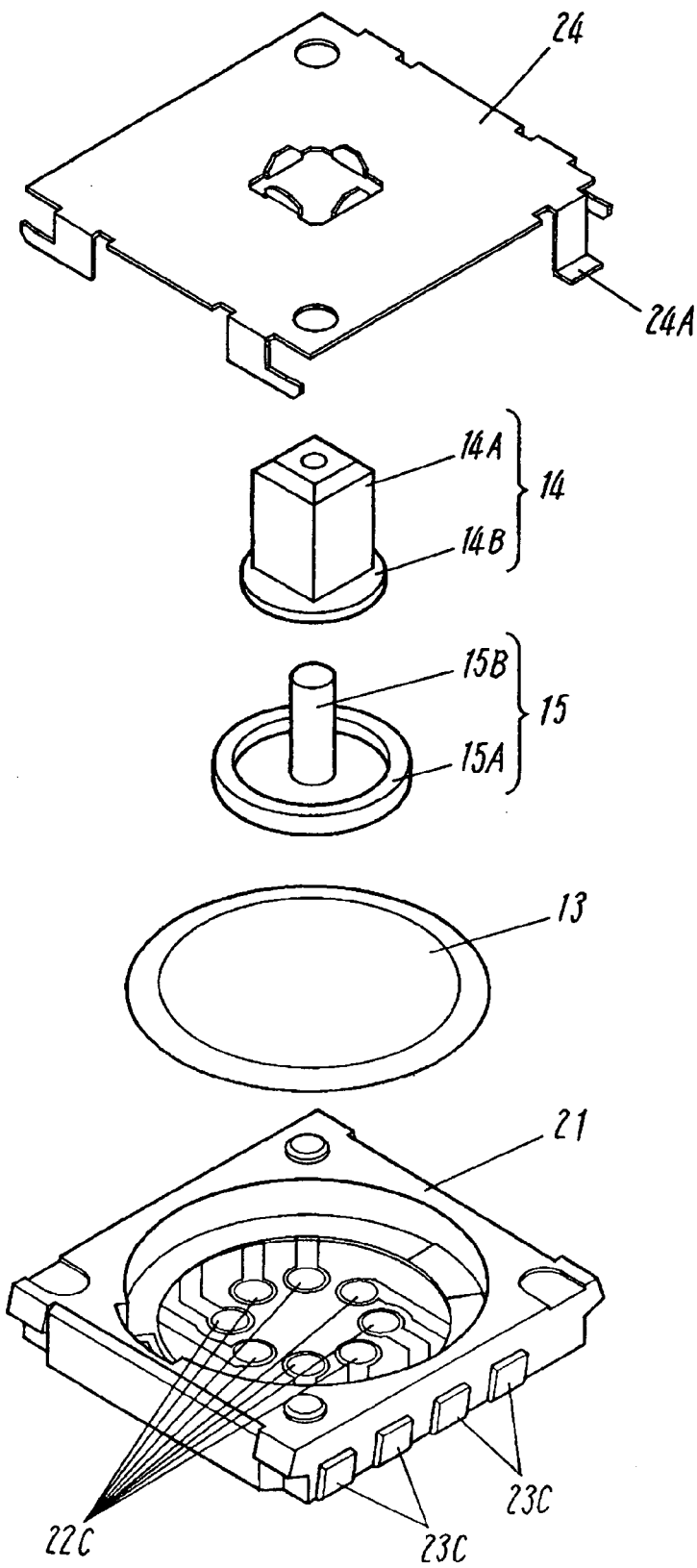
FIG. 6 is an exploded perspective view of another multidirectional operation switch according to the embodiment.

FIG. 6 is an exploded perspective view of another multidirectional operation switch according to the embodiment. The switch shown in FIGS. 1 to 5 includes case 11 having two outer fixed contacts 12B and two terminals 18B thereon. The switch shown in FIG. 6 includes case 21 having single outer fixed contact 12B and single terminal 18B led out from the outer fixed contact 12B. Cover terminal 24A electrically connected to cover 24 is provided on a position corresponding to one of two terminals 18B of the switch shown in FIGS. 1 to 5. Terminals 23C arranged on an outer side surface of case 21 and led from the inner fixed contacts 22C are aligned with cover terminal 24A along a single line, hence allowing the switch to be small even including soldering portions. Further, this arrangement allowing lands of a wiring board of an apparatus for soldering to be easily provided.

Figure 7:
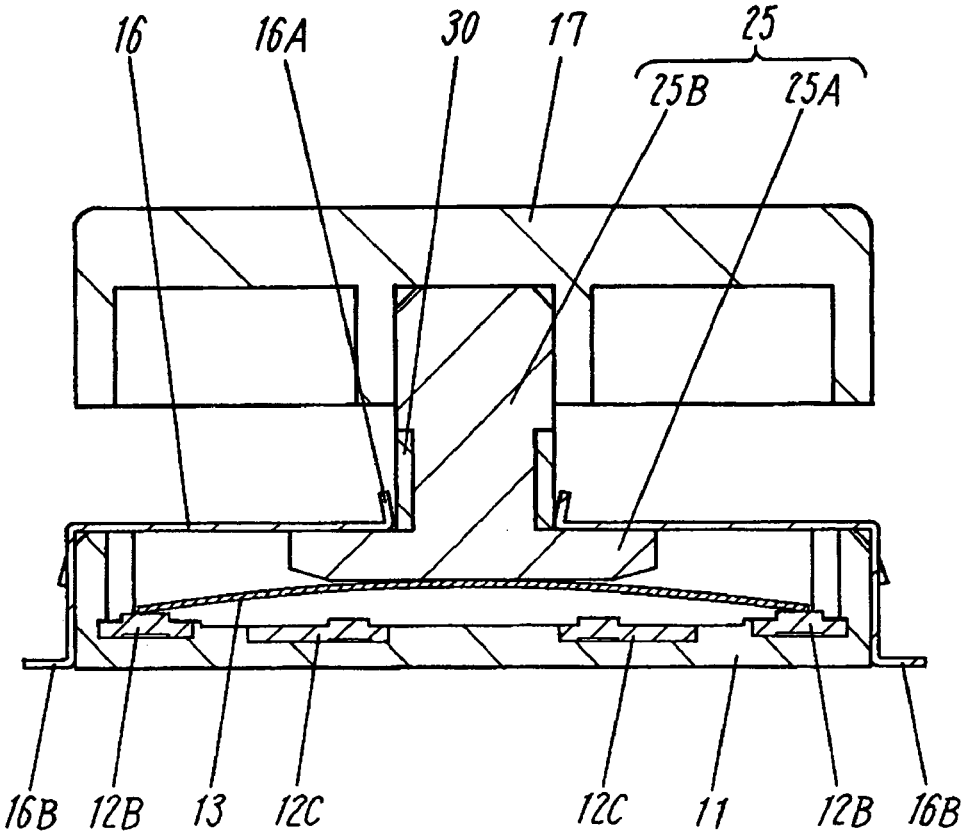
FIG. 7 is a sectional view of a further multidirectional operation switch according to the embodiment.
Figure 8:
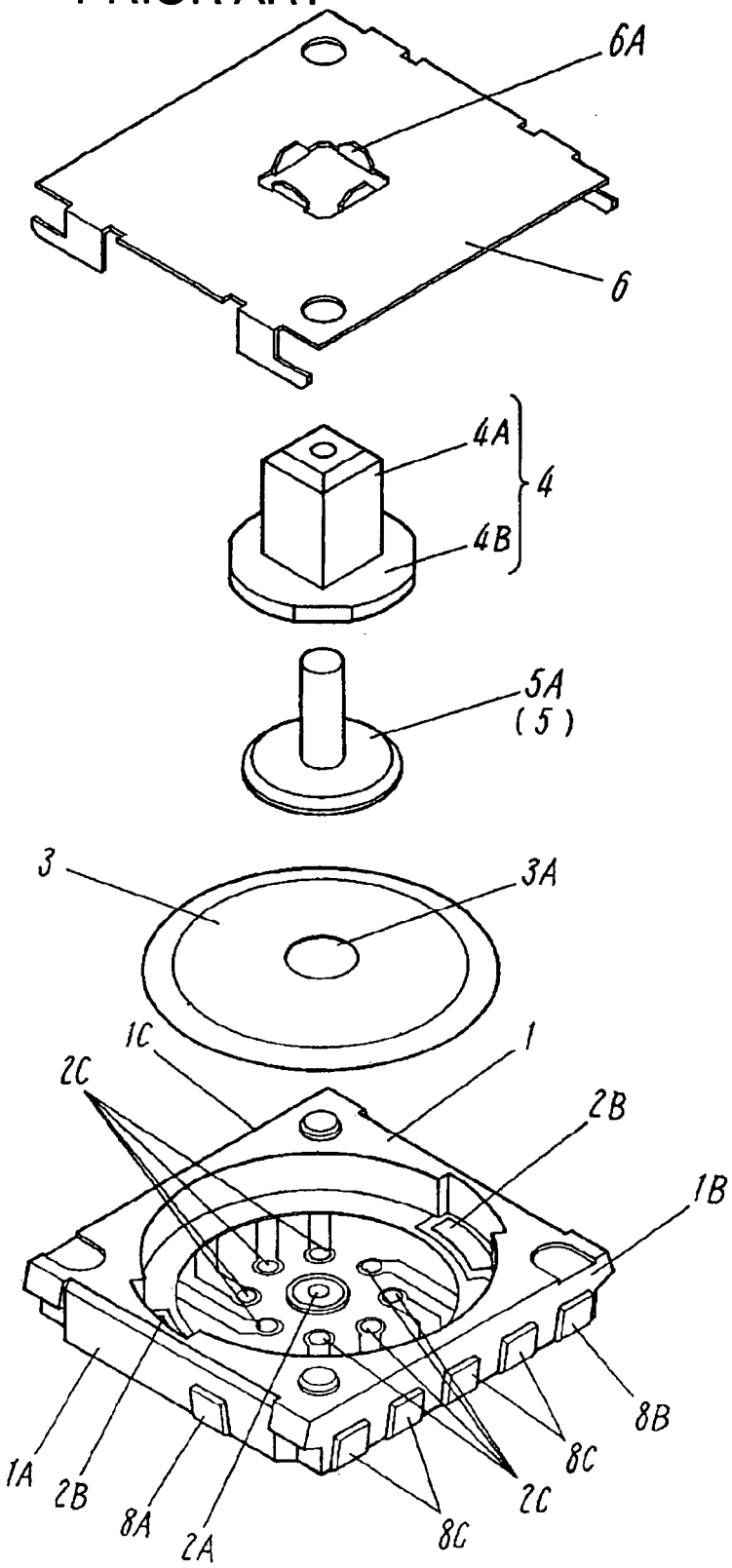
Fig. 8 PRIOR ART
FIG. 8 is an exploded perspective view of a conventional multidirectional operation switch.
Figure 9:
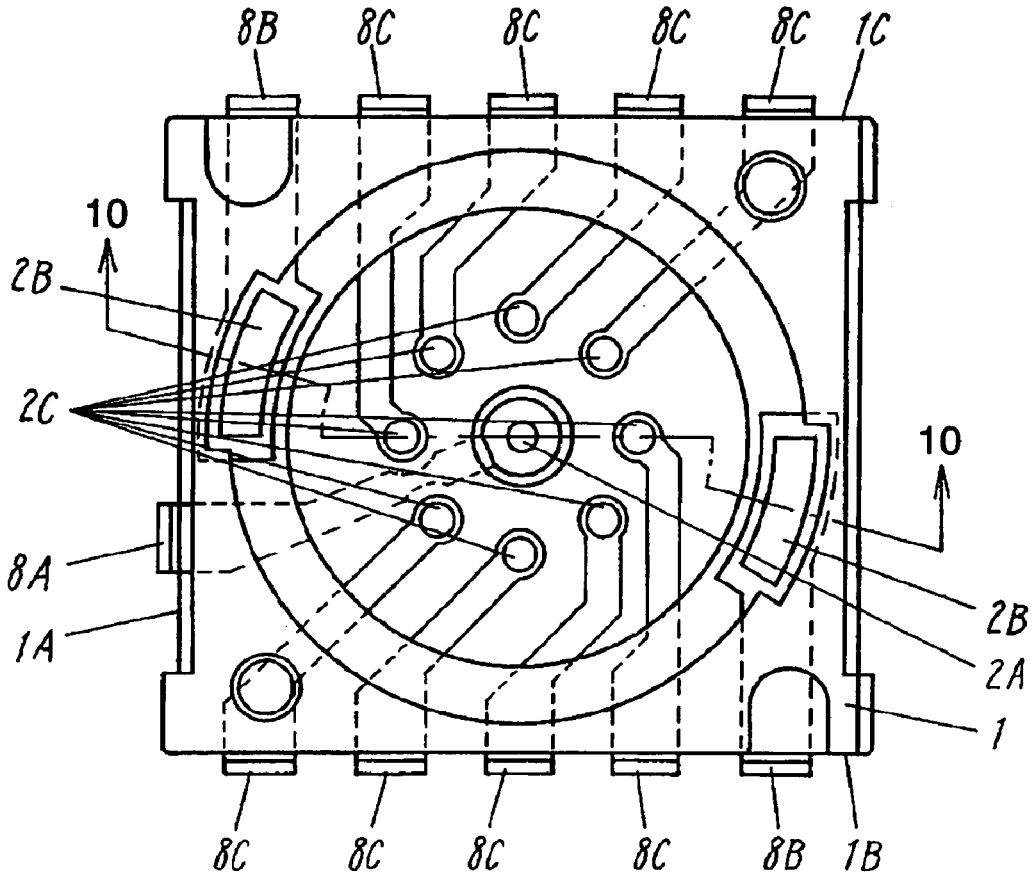
Fig. 9 PRIOR ART
FIG. 9 is a plan view of a case of the conventional multidirectional operation switch.
Figure 10:
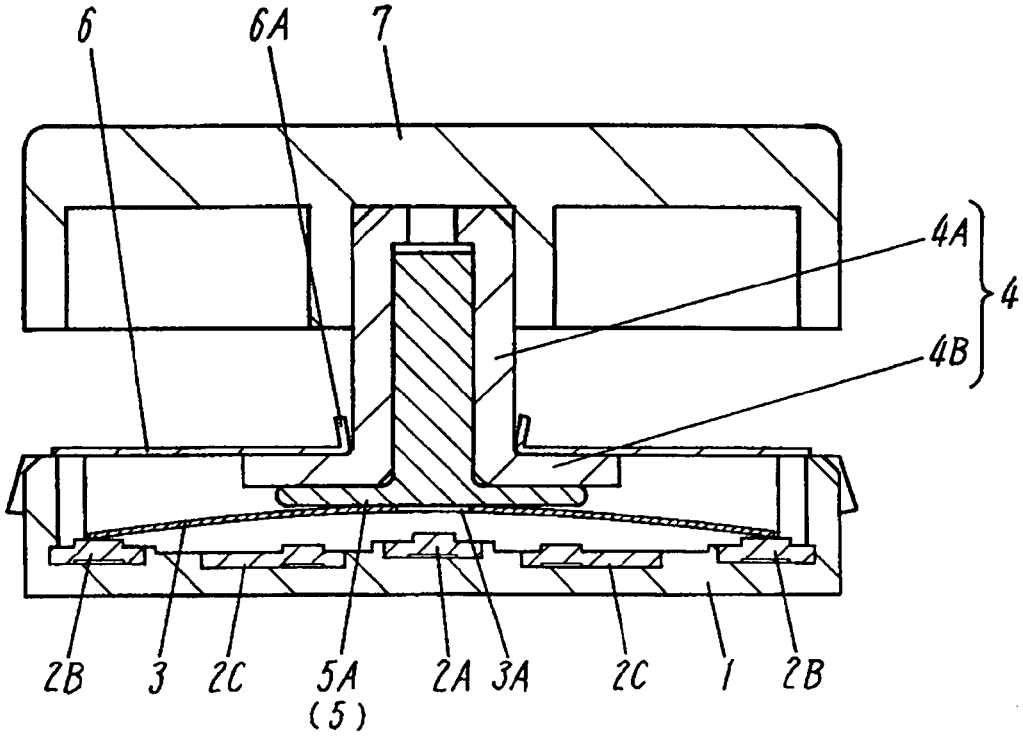
Fig. 10 PRIOR ART
FIG. 10 is a sectional view of the conventional multidirectional operation switch taken along line 10—10 of FIG. 9.
Figure 11:
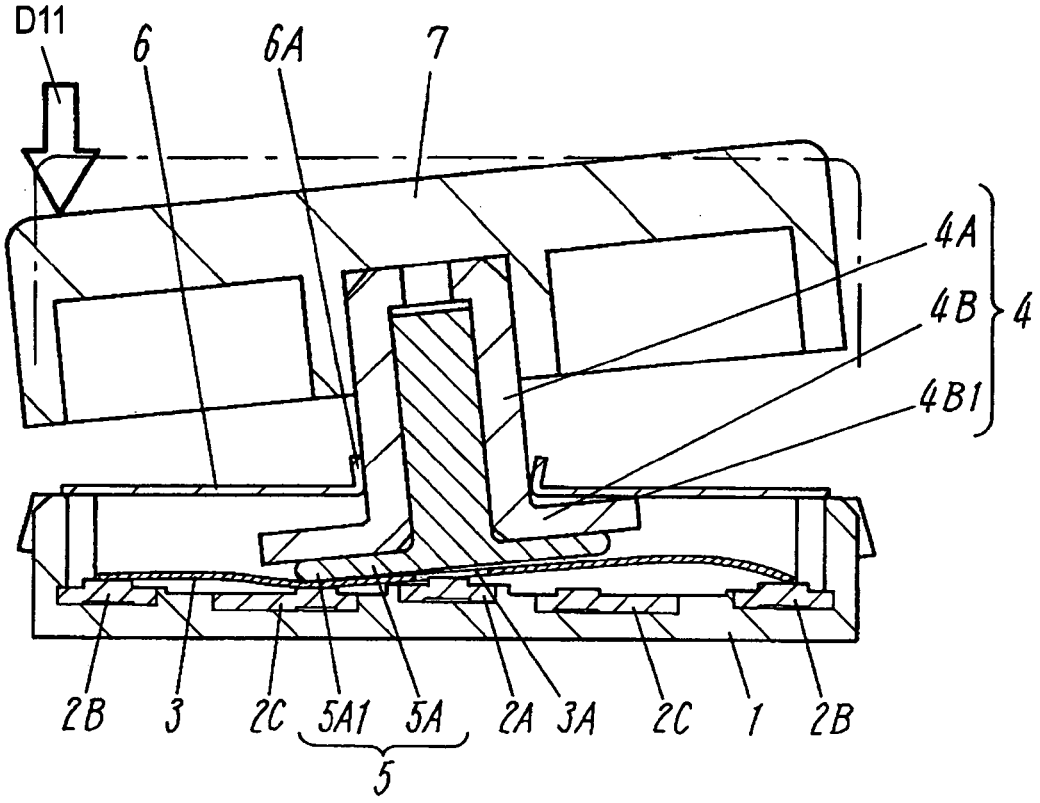
Fig. 11 PRIOR ART
FIG. 11 is a sectional view of the conventional multidirectional operation switch which is activated.
Figure 12:
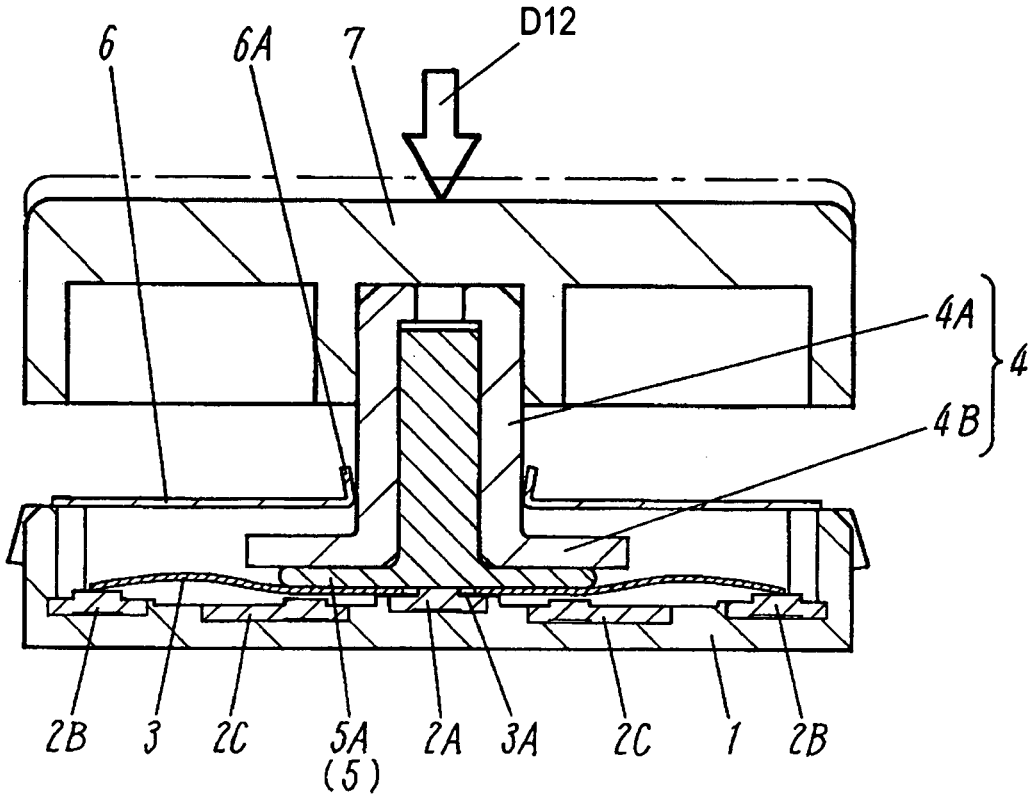
Fig. 12 PRIOR ART
FIG. 12 is a sectional view of the conventional multidirectional operation switch which is activated.

FIG. 7 is a sectional view of a further multidirectional operation switch according to the embodiment. Flange 14B of operation body 14 and disk-like portion 15A of rivet portion 15 shown in FIG. 3 correspond to flange 25A formed of single conductive material shown in FIG. 7. Operation body 25 includes flange 25A and operation shaft 25B. Hence, the switch is composed of a small number of components. Flange 25A can be formed accurately, thus allowing the switch to respond to a tiling operation and a pushing operation. Insulation member 30 provided between operation shaft 25B and bearing portion 16A of cover 16 electrically insulate cover 16 from operation body 25 reliably in the pushing operation.

The switch according to the embodiment has eight inner fixed contacts 12C. The number of contacts 25C is not limited to eight, but may be, for example, four, providing the same effect.

Cover terminal 16B is not necessarily required. An electrical connection between cover 16 and disk-like portion 15A, i.e., an electrical connection between the cover 16 and flange 25A may be detected via conductive member, such as a spring, directly contacting cover 16 instead of cover terminal 16B.

The shape of the cross section of operation shaft 14A is not limited to the quadrangular shape. Operation body 14 may have any shape other than a circular shape as long as the shape operation body 14 cannot rotate with respect to cover 16.

What is claimed is:

1. A multidirectional operation switch comprising:

an insulation case having a recess formed therein, the recess having a bottom, the case having an outer surface;

an outer fixed contact provided on the bottom;

a plurality of inner fixed contacts provided on the bottom, each of the plurality of the inner fixed contacts departing from a predetermined point on the bottom by a predetermined distance shorter than a distance between the predetermined point and the outer fixed contact;

a conductive cover for covering the recess of the case, the cover having a hole formed therein over the predetermined point on the bottom;

a movable contact made of resilient conductive plate and accommodated in the recess of the case, the movable contact having a dome shape including a concave surface, a convex surface opposite to the concave surface, and a peripheral edge, the peripheral edge being mounted on the outer fixed contact, the concave surface facing the plurality of inner fixed contacts, the concave surface having a deepest point located over the predetermined point on the bottom of the recess;

an operation body including an operation shaft inserted into the hole of the cover and electrically insulated from the cover, and a conductive flange bonded to the operation shaft, the flange being located between the cover and the convex surface of the movable contact and over the plurality of inner fixed contacts, the flange contacting the cover and the convex surface of the movable contact in an ordinary state in which the operation shaft is not activated;

a plurality of first terminals provided on the outer surface of the case, the first terminals being electrically connected to the outer fixed contact and the plurality of inner fixed contacts, respectively; and a second terminal electrically connected to the cover, the second terminal being arranged to electrically connect the case to an outside of the multidirectional operation switch.

2. The multidirectional operation switch according to claim 1, wherein the plurality of inner fixed contacts are arranged at equal angular intervals from the predetermined point.

3. The multidirectional operation switch according to claim 1, wherein the second terminal is located on the outer surface of the case.

4. The multidirectional operation switch according to claim 3, wherein the outer surface of the cover includes a plurality of outer side surfaces, and wherein the second terminal and at least one of the plurality of first terminals are located on the plurality of outer side surfaces.

5. The multidirectional operation switch according to claim 4, wherein the plurality of first terminals are provided on the plurality of the outer side surfaces.

6. The multidirectional operation switch according to claim 1, wherein the flange of the operation body is entirely made of conductive material.

7. The multidirectional operation switch according to claim 6, wherein the operation shaft of the operation body is unitarily formed with the flange and made of the conductive material, and wherein the operation body further includes an insulation member provided on a portion of the shaft portion located at the hole of the cover.

8. The multidirectional operation switch according to claim 1, wherein the concave surface of the movable contact has a deepest point facing the predetermined point on the bottom.

9. The multidirectional operation switch according to claim 1, wherein a portion between the predetermined point of the case and each of the plurality of inner fixed contacts, including the predetermined point, is lower than the inner fixed contact.

* * * * *